US009010341B1

(12) United States Patent
Lee

(10) Patent No.: US 9,010,341 B1
(45) Date of Patent: Apr. 21, 2015

(54) HAIR EXTENSION CLIP

(71) Applicant: Chang Moo Lee, Moonachie, NJ (US)

(72) Inventor: Chang Moo Lee, Moonachie, NJ (US)

( * ) Notice: Subject to any disclaimer, the term of this patent is extended or adjusted under 35 U.S.C. 154(b) by 0 days.

(21) Appl. No.: 14/585,326

(22) Filed: Dec. 30, 2014

(51) Int. Cl.
*A41G 5/00* (2006.01)
*A45D 8/30* (2006.01)
*A41G 3/00* (2006.01)

(52) U.S. Cl.
CPC *A41G 5/004* (2013.01); *A45D 8/30* (2013.01); *A41G 5/0073* (2013.01); *A41G 5/0026* (2013.01); *A41G 3/0033* (2013.01)

(58) Field of Classification Search
CPC ..... A45D 8/00; A45D 8/20; A45D 8/22; A45D 8/30; A45D 8/40; A41G 3/0008; A41G 3/0016; A41G 3/0033; A41G 5/0013; A41G 5/0026; A41G 5/0073; Y10T 24/1394; Y10T 24/1391; Y10T 24/304; Y10T 24/44017; A42B 7/00; A42B 5/00
USPC ..... 132/201, 101, 105, 273, 276, 53, 54, 132/57.1, 60, 63.1
See application file for complete search history.

(56) References Cited

U.S. PATENT DOCUMENTS

| | | | | |
|---|---|---|---|---|
| 1,595,595 | A * | 8/1926 | Bonat et al. | 132/105 |
| 2,300,437 | A * | 11/1942 | Solomon | 132/252 |
| 2,366,816 | A * | 1/1945 | Stapleton | 24/561 |
| 3,699,978 | A * | 10/1972 | Holly | 132/53 |
| 5,497,796 | A * | 3/1996 | Mochizuki et al. | 132/201 |
| 5,601,099 | A * | 2/1997 | Mochizuki et al. | 132/201 |
| 7,735,495 | B2 * | 6/2010 | Lane et al. | 132/53 |
| 2003/0154994 | A1 * | 8/2003 | Ra | 132/53 |
| 2005/0115581 | A1 * | 6/2005 | Choi | 132/53 |
| 2007/0157941 | A1 * | 7/2007 | Awad et al. | 132/53 |
| 2007/0221244 | A1 * | 9/2007 | Lane et al. | 132/276 |
| 2010/0139679 | A1 * | 6/2010 | Umezu et al. | 132/106 |
| 2013/0233330 | A1 * | 9/2013 | Nagatomo et al. | 132/53 |
| 2014/0326263 | A1 * | 11/2014 | Miyatake et al. | 132/54 |

FOREIGN PATENT DOCUMENTS

| | | | | |
|---|---|---|---|---|
| GB | 191111024 | A * | 0/1912 | A42B 7/00 |
| KR | 10-1455538 | | 10/2014 | |

OTHER PUBLICATIONS

Clips.pdf—various clips, Dec. 8, 2014.
Weaving.pdf—weaves, Dec. 8, 2014.

* cited by examiner

*Primary Examiner* — Robyn Doan
*Assistant Examiner* — Tatiana Nobrega
(74) *Attorney, Agent, or Firm* — Michael J. Feigin, Esq.; Feigin & Associates, LLC

(57) ABSTRACT

A hair clip having a rectangular base frame, with a plurality of prongs forming a unitary structure with the base frame, is disclosed. A weft clip frame is fixedly attached to, or forms a unitary structure with, the base frame. The weft clips which are attached thereto form a U-shape with a portion of said U-shape on either side of the rectangular base frame and extend over an uppermost extremity of the rectangular base, while the lower end of the rectangular base has openings of prongs for attaching hair thereto. The weft clips, in embodiments, hold the weft of a hair extension between the weft clip and rectangular base, such as in a portal of the weft clip opening only towards the top of the rectangular base.

14 Claims, 9 Drawing Sheets

HAIR EXTENSION CLIP

FIELD OF THE DISCLOSED TECHNOLOGY

The disclosed technology relates generally to hair accessories and, more specifically, to hair clips.

BACKGROUND OF THE DISCLOSED TECHNOLOGY

Hair extensions add length to the hair by clipping, gluing, sewing, weaving, or otherwise adding hair to one's head. Rather than wait months to grow one's hair to a desired length and having to spend extensive amounts of time styling the hair, one can simply add an extension to one's existing hair. Hair extensions can be styled like regular hair, but last up to three months without the need for further styling.

One downside to hair extensions is the time necessary to weave, glue, or sew hair extensions into your own hair. A woman might spend hours at a salon getting hair extensions installed. While clipping hair extensions in can be less time-consuming, the clips tend to lack strength; e.g., if the hair becomes caught on an object or is pulled too hard, the entire extension can become disconnected from the hair. Further, the tension of clips can weaken over time, meaning that the hair extension is not held as firmly as it once was.

Thus, there is a need in the art to provide improved hair clips which are inexpensive to manufacture, easy to use, and which hold hair extensions well.

SUMMARY OF THE DISCLOSED TECHNOLOGY

Therefore, it is an object of the disclosed technology to create a hair clip from which the hair extension cannot be pulled out easily. Removal requires moving the hair extension in a direction transverse to, or opposite of, the direction in which the hair falls naturally.

As such, in an embodiment of the disclosed technology, a hair clip has a rectangular base frame with upper and lower sides longer than left and right sides. A cushion frame is fixedly attached to, and extending across a lower longest length of the rectangular base frame, the "lower longest length" being at a side closest to where the bulbous tip of the prongs (to be described below) end, and embodiments, being the longest length which is closest to the elastic cushion frame. The elastic cushion is wrapped around the largest part or majority of a cushion frame, in this embodiment, and a plurality of prongs form a unitary structure with the base frame extending from an upper longest length of the base frame, the prongs held with tension against the elastic cushion. A weft clip frame is fixedly attached to, and extends across the upper longest length of the rectangular base frame. Two spaced-apart weft clips form a unitary structure with the weft clip frame, the weft clips forming a U-shape, where a portion of the U-shape is on either side of the rectangular base frame and extends over an upper-most extremity of the longer upper side.

The weft clip further can fold back into itself, within the U-shape, forming a hollow pocket within the fold. The hollow pocket can open, in embodiments, only at an opening facing towards the portion of said U-shape extending over the upper most extremity of the longer upper side. This can be such that there is no opening to the pocket in the same direction as that of the opening between the weft clip and rectangular base frame, in this embodiment. The weft of a hair extension can be placed into the pocket, thereby preventing removal of the hair clip by pulling the hair extension away from the hair. The hair extension can be frictionally held between the base and the weft clips in this manner.

In some embodiments, the hair clip has a top portion of a base with weft clips that curve into themselves forming a frictional attachment mechanism between the top portion of the base and each of the weft clips. Each such weft clip has a continuous hollow pocket for which a majority thereof is bisected by each respective curve turning into itself. A plurality of prongs extends from the top portion of the base past a bottom portion of the base, the bottom portion on an opposite side of a hollow area of the base between the top and bottom portions. The plurality of prongs can form a frictional attachment mechanism between the plurality of prongs and the bottom portion of the base.

A weft clip frame can be fixedly attached to, and extend across, the upper longest length of the rectangular base frame on which each weft clip is held there-against. This hair clip can have a weft clip with a U-shape on either side of the rectangular base. The weft clips can hold a weft slid between each of the weft clips and the base. The weft can be held within each continuous hollow pocket of each weft clip after passing around and into the afore-described curve turning into itself. A bulbous portion can be in the hollow pocket, being defined by the curve turning into itself and two sides of the U-shape portion of the weft clip. A cushion frame fixedly attached to, and extending across said rectangular base frame with an elastic cushion wrapped around a majority of said cushion frame. "Bulbous" for purposes of this disclosure, is defined as a curvilinear shape having at one end two sides of the curvilinear exterior parallel, or substantially parallel, and an interior portion which is greater apart in width than the end with two parallel sides, this interior portion having sides which angle towards each other.

The described hair clip can be used in the following manner. Some weft of a hair extension can be slid in a direction from a bottom of a rectangular base of a hair clip towards a top of the rectangular base of the hair clip, the top having (and being defined by) at least two spaced-apart weft clips, while the bottom is the side opposite this top side. Then, the weft can be pushed between the weft clips and the base. Human hair is that placed or pushed between a plurality of prongs and the base, the plurality of prongs extending from a side opposite the weft clips. A step of rotating the weft into an inner area of each weft clip used, this being done simultaneously at each weft clip, can be carried out in embodiments of the disclosed technology. The inner area is defined by a bisection of each of the weft clips curved into itself and being surrounded, at least 270 degrees, by one of the weft clips, itself. This inner area may be bulbous.

In a further embodiment of the disclosed method, an additional step may be provided of parting the hair at the first part, such that the first distinct shade is substantially shown. "Substantially" and "substantially shown," for purposes of this specification, are defined as at least a majority of at least 90% of the hairs being visible from the outside of the hairpiece, or simply "90% or more." The step of attaching hair may involve either hand-tying or wefting hair strands to said hairpiece.

It should be understood that the use of "and/or" is defined inclusively such that the term "a and/or b" should be read to include the sets: "a and b," "a or b," "a," "b."

DETAILED DESCRIPTION OF EMBODIMENTS OF THE DISCLOSED TECHNOLOGY

In an embodiment of the disclosed technology, a hair clip having a rectangular base frame, with a plurality of prongs forming a unitary structure with the base frame, is disclosed. A weft clip frame is fixedly attached to, or forms a unitary structure with, the base frame. The weft clips which are attached thereto form a U-shape with a portion of said U-shape on either side of the rectangular base frame and extend over an uppermost extremity of the rectangular base, while the lower end of the rectangular base has openings of prongs for attaching hair thereto. The weft clips, in embodiments, hold the weft of a hair extension between the weft clip and rectangular base, such as in a portal of the weft clip opening only towards the top of the rectangular base.

The embodiments of the disclosed technology will become clearer in view of the following description of the figures.

Figure 1:
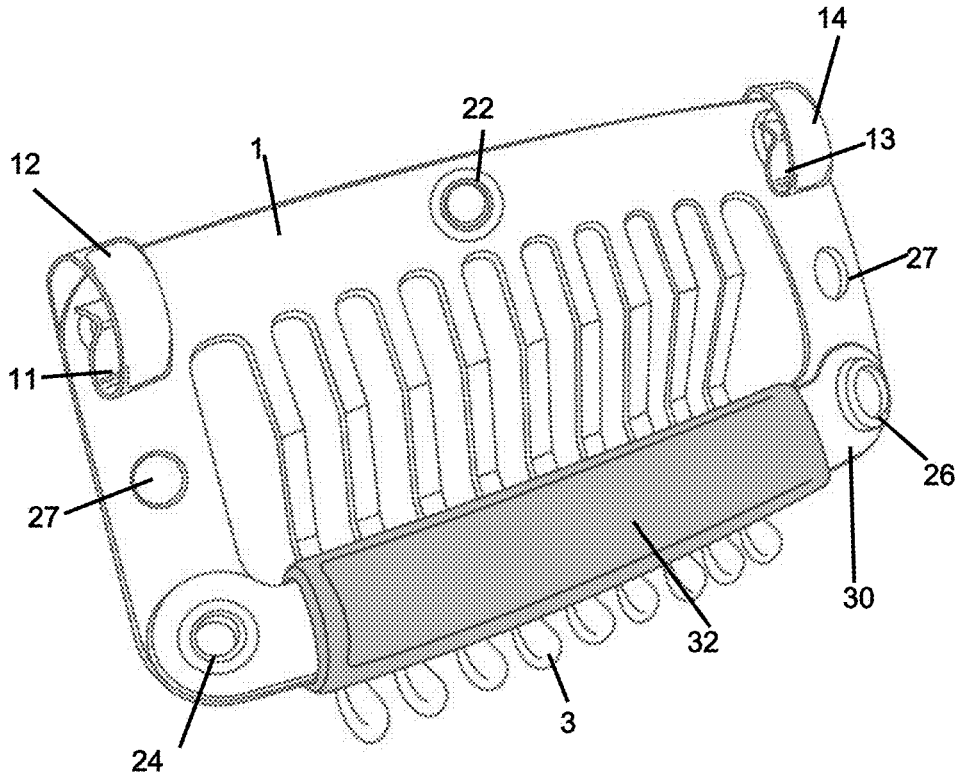
FIG. 1 shows a front isometric view of a clip of the disclosed technology.

FIG. 1 shows a front isometric view of a clip of the disclosed technology. A clip of an embodiment has a base frame 1 which can be rectangular, rounded rectangular, or any other planar shape. Forming a unitary structure and procured from the same piece of material are a plurality of prongs which, in a resting condition, press against a cushion frame 30 by way of a rubber cushion 32. The cushion frame 30 is along one side of the base frame adjacent to (closer to) the ends of the prongs 3, the cushion frame 30 touching a part of a bulbous tip of each or most of the prongs, in embodiments. Portals and fasteners in 24 and 26 can attach the cushion frame 30 to the base frame 1. Further portals 27 can be on either side of the mid-region of the base frame, and portal 22 at a top of the base frame. The "top" or "upper" of the frame is defined as the side opposite the cushion 32 and/or bulbous area of the prongs 3 and extends no more than ⅓ of the width of the device. The "bottom" or "lower" portion of the frame is the part beginning below the portal over which the prongs extend and at the cushion frame, again, extending no more than ⅓ of the width of the device. Two wefts holding clips 12 and 14 are shown. Each clip has a respective pocket 11 and 13. The weft clips 12 and 14 form a unitary structure with the base 1, or are attached via connectors, as shown in later figures.

Figure 2:
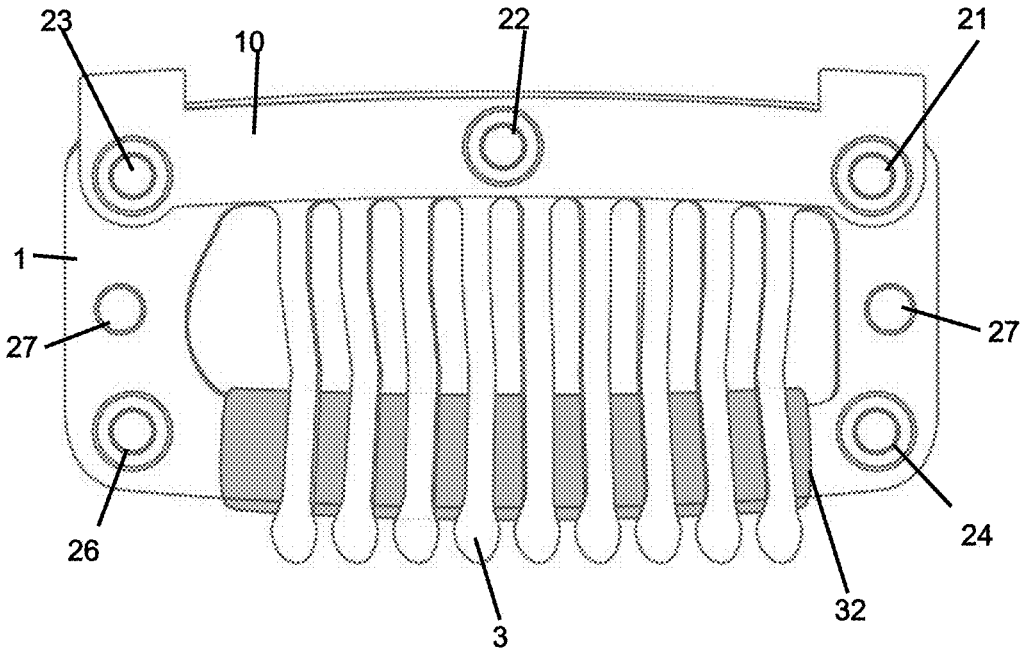
FIG. 2 shows a rear plan view of the clip of an embodiment of the disclosed technology.

FIG. 2 shows a rear plan view of the clip of an embodiment of the disclosed technology. Here, one can see the weft clips 12 and 14 (shown in FIG. 1) form a unitary structure which is further procured from, and part of, the same material as an entire weft clip frame 10 which extends substantially along the top of the clip. The weft clip frame 10 is attached to the base frame at any one of, or each of, portals and connectors 21, 22, and 23. Thus, the base frame and clip frame are fastened together, or, in other embodiments, can be the same structure. Portals/connectors 24 and 26 can also be used to further fasten the base frame 1 to the weft clip frame 10.

Figure 3:
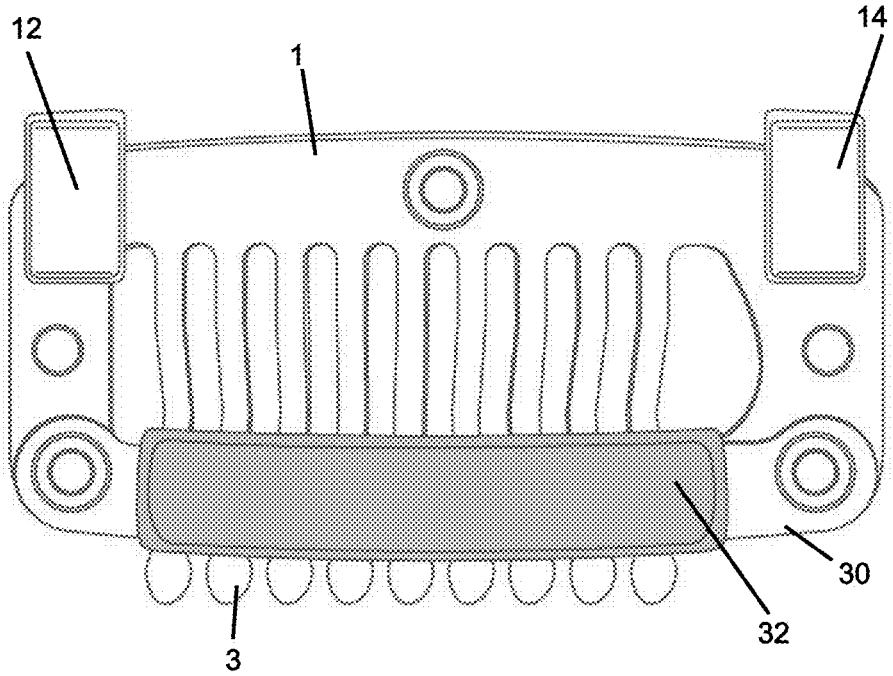
FIG. 3 shows a front plan view of the clip of an embodiment of the disclosed technology.

FIG. 3 shows a front plan view of the clip of an embodiment of the disclosed technology. The front of weft clips 12 and 14 are shown in front of and on the clip base 1.

Figure 4:
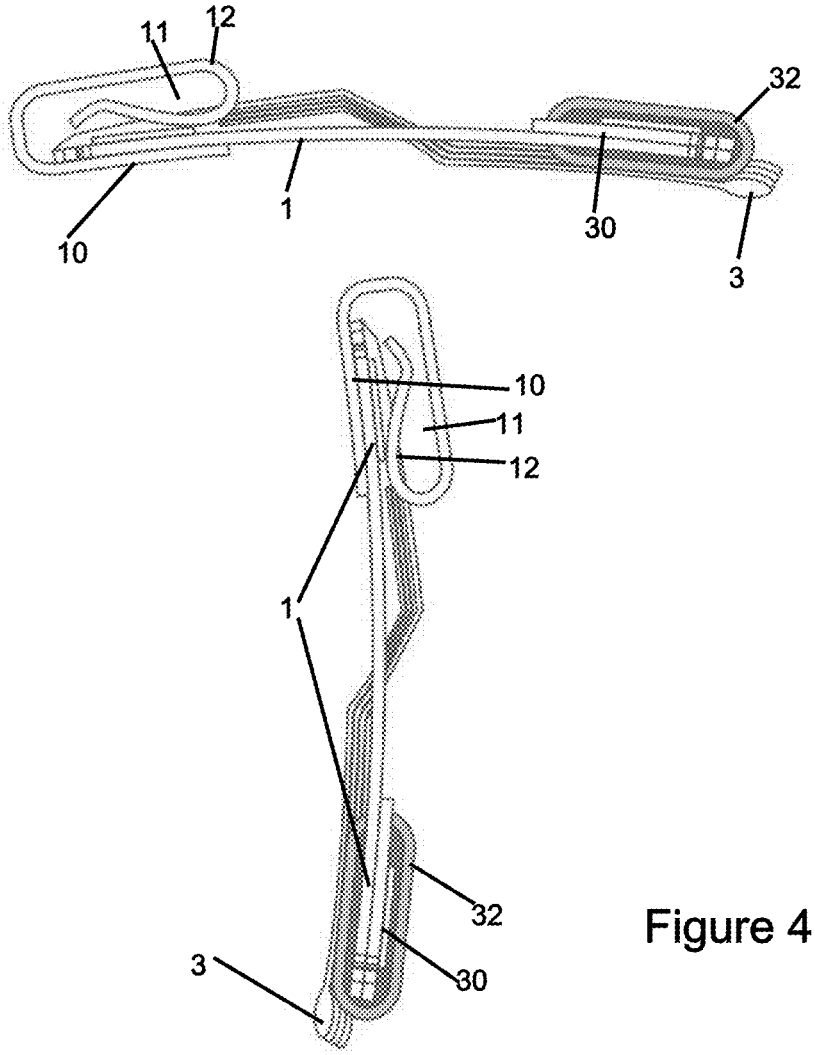
FIG. 4 shows side views of the clip of an embodiment of the disclosed technology.

FIG. 4 shows side views of the clip of an embodiment of the disclosed technology. In these side views, one of the weft clips 12 is shown with a weft clip pocket 11. The clip, in embodiments, forms a unitary structure with the weft clip frame 10. The weft clip frame 10 is fixedly attached by a connector to a clip base in some embodiments. In other embodiments, the clip frame and base frame are formed of a single construction, such as procured from a continuous and uninterrupted piece of metal or plastic. In still further embodiments, the weft clip 12 circles back on itself, such that it forms a U-shaped region. This U-shaped region has two equal, or substantially equal, longer sides and one short side (the base of the "U"). One of the longer sides starts (or is part of) the base frame 1 and continues away from the bottom of the clip base 1 until reaching a top most region of the clip. The narrow portion of the "U" then runs perpendicular to the elongated planar side of the base clip 1, and the second longer side of the "U" extends back towards the bottom of the clip. The longer sides of the "U" shaped portion of each weft clip (12 and 14) can be parallel, in embodiments of the disclosed technology. From the second longer side of the "U" a pocket (11 and 13) can be formed by further extending the clip towards the top direction of the clip, such that the weft clip folds back into itself.

Figure 5:
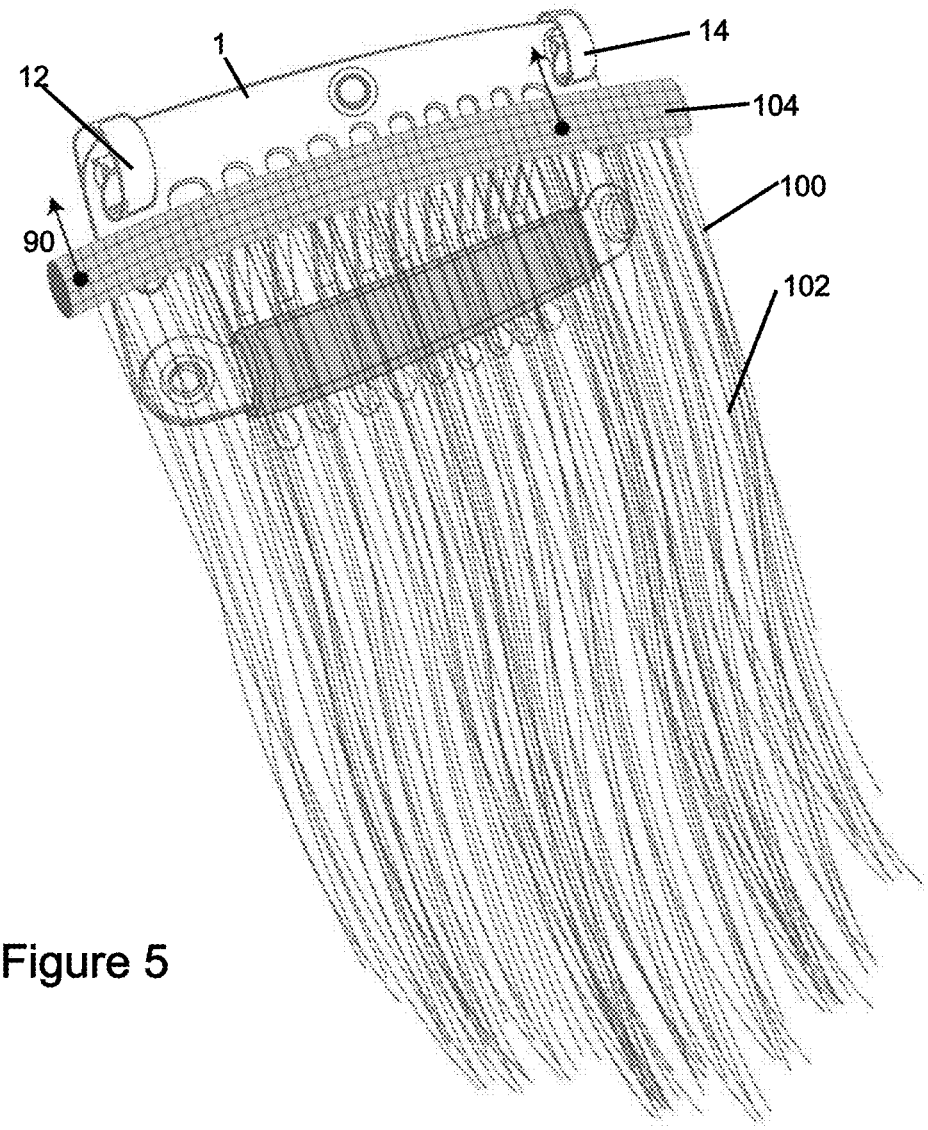
FIG. 5 shows a rear view of the clip with hair extension being attached thereto in an embodiment of the disclosed technology.

FIG. 5 shows a rear view of the clip with hair extension being attached thereto, in an embodiment of the disclosed technology. A hair extension 100 is shown with two main portions—the hair 102 and the weft 104. The weft 104, for purposes of this disclosure, is either cross-linked fibers or other pliable material to which the hair 102 attaches. To attach the hair extension 100 to the clip base 1, the weft 104 is inserted between the clips 12/14 and the clip base 1 by moving the weft in the direction 90, as shown. This direction is defined as "towards the top" of the hair clip, the top being further defined as the most elongated side of the hair clip base 1 to which the weft is adjacent when attached under the weft clips 12 and 14. The weft is then frictionally held to the hair clip. The prongs 3 of the hair clip then can be attached to human hair (already connected to a head of a person, such as growing hair attached to the scalp), so that the hair extension 100 is attached to the hair. This is shown in later figures.

Figure 6:
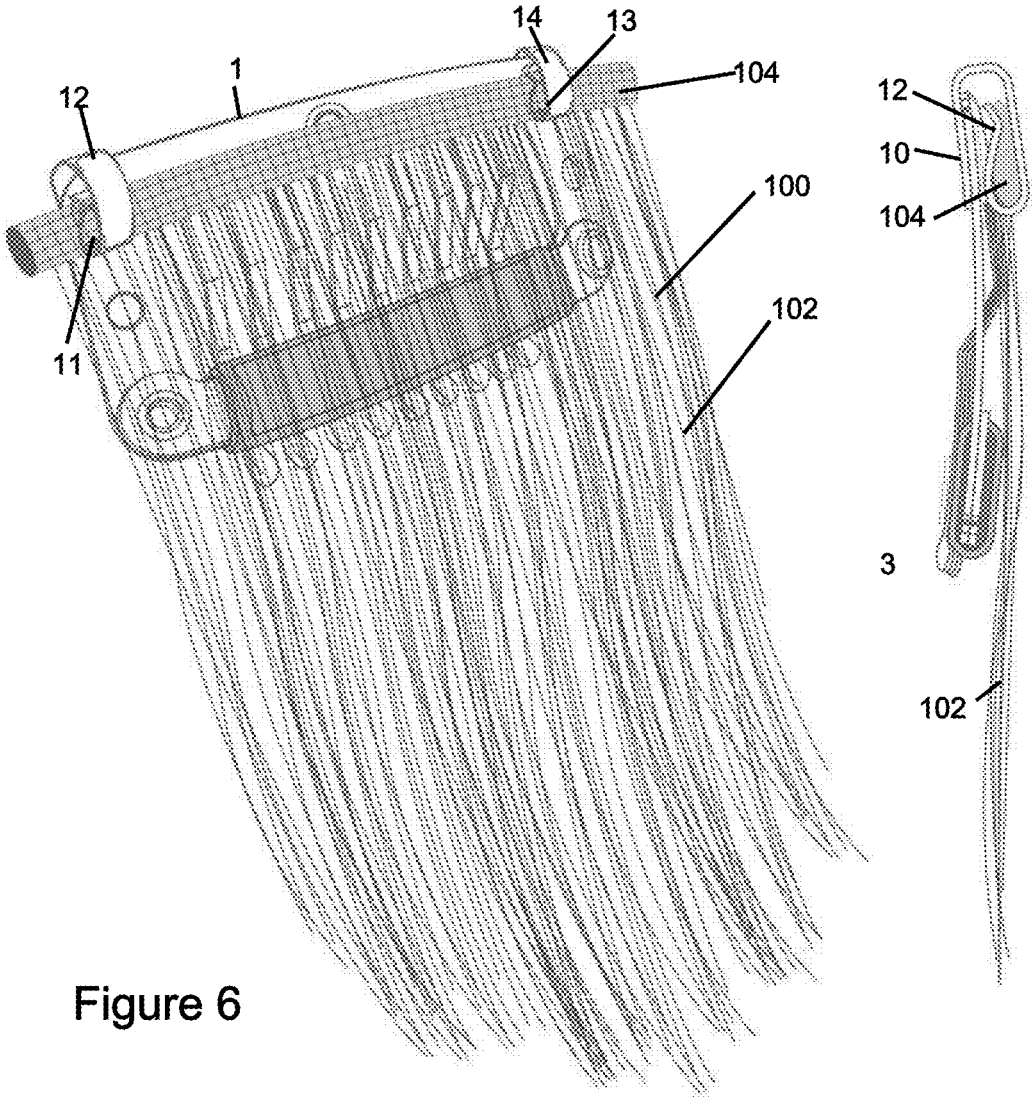
FIG. 6 shows a rear view of the clip with hair extension attached thereto in an embodiment of the disclosed technology.

FIG. 6 shows a rear view of the clip with hair extension attached thereto, in an embodiment of the disclosed technology. In this figure, the hair extension 100 is fully connected to the hair clip. The weft 104, after being pushed as much as possible towards the top of clip 1, until pressed against the afore-described narrow side of the "U" of weft clips 12 and 14, can then be inserted into the weft pockets 11 and 13. This adds strength to the connection between the hair clip base 1 and hair extension 100, because a simple pull, which detaches hair clips of the prior art, is not effective in detaching the hair extension 100 from the clip base 1, as the weft is in the weft pockets 11 and 13, surrounded on four sides, except for a small opening, by the weft clips 12 and 14. To remove the weft 104 of the hair extension 100, one must either slide the weft transverse to the hair clip base 1 or pull the weft towards the top of the hair clip first (in the direction 90, shown in FIG. 5).

This is counter-intuitive since it is the same first direction used to attach the extension 100 and the opposite direction of desired detachment.

Figure 7:
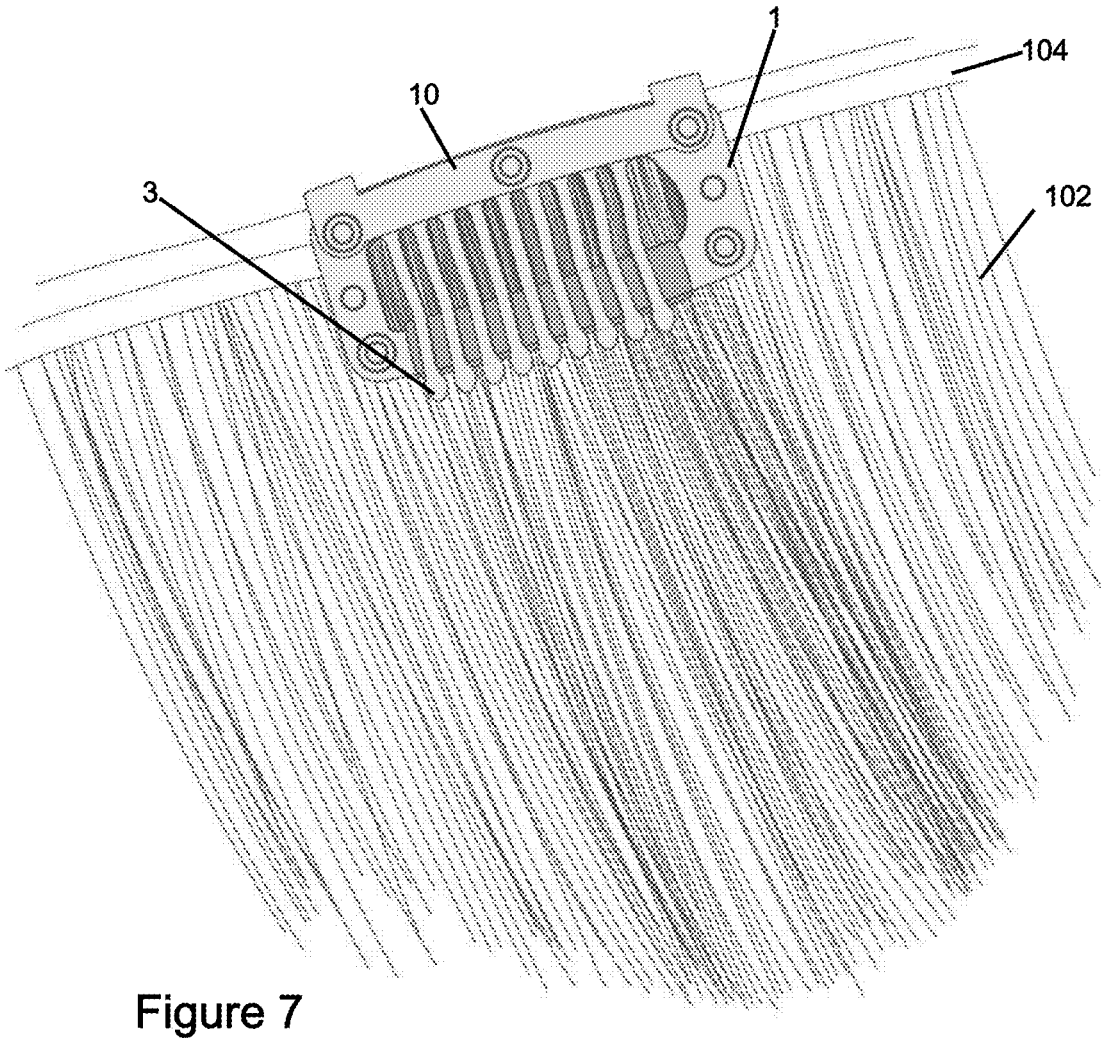
FIG. 7 shows a front view of the clip with hair extension attached in an embodiment of the disclosed technology.

FIG. 7 shows a front view of the clip with hair extension attached, in an embodiment of the disclosed technology. Here, the weft 104 is fully inserted into the weft clips 12 and 14, as described with reference to FIG. 6. The clip with base 1 is removable from the hair 103 by sliding the hair in a direction which extends between the two weft clips, but is not removable by pulling the hair extension 102 in the direction away from the top of the clip/towards the bottom of the clip, the bottom being defined as the side of the clip base 1 closest to the bulbous tips of the prongs 3.

Figure 8:
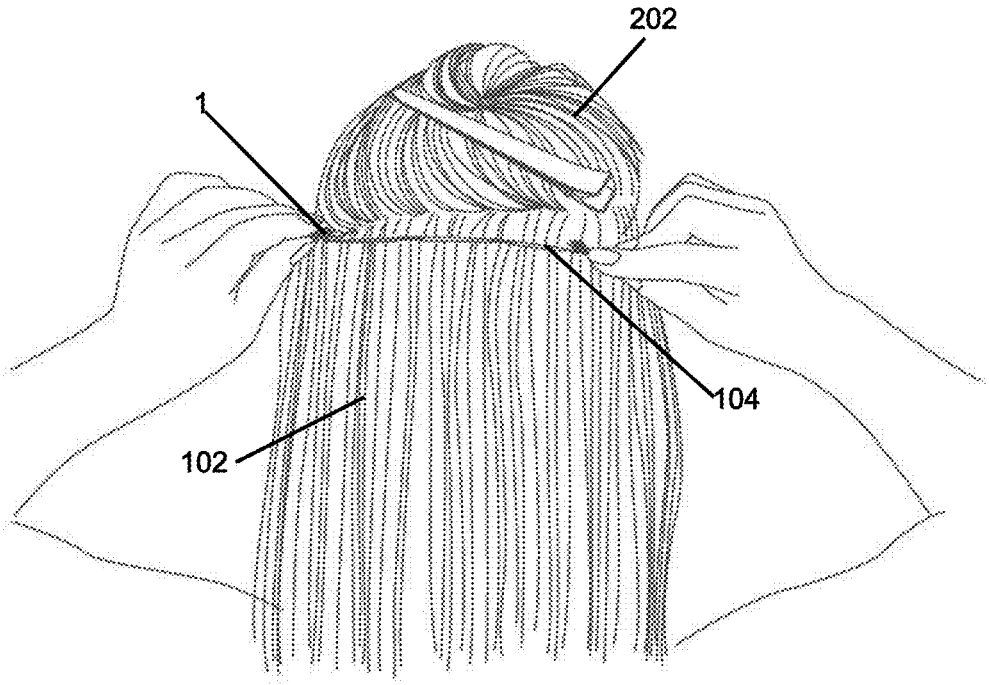
FIG. 8 shows a side elevation view of the hair extension being attached to hair in an embodiment of the disclosed technology.

FIG. 8 shows a side elevation view of the hair extension being attached to hair in an embodiment of the disclosed technology. Here, clip base 1 has already been attached to hair extension 102 via the weft 104. The human hair 202 is then placed between the clip base 1 and prongs 3 (shown in prior Figures, such as FIG. 7) so as to attach the hair extension 100 to the hair 202 of a person via the clip and weft.

Figure 9:
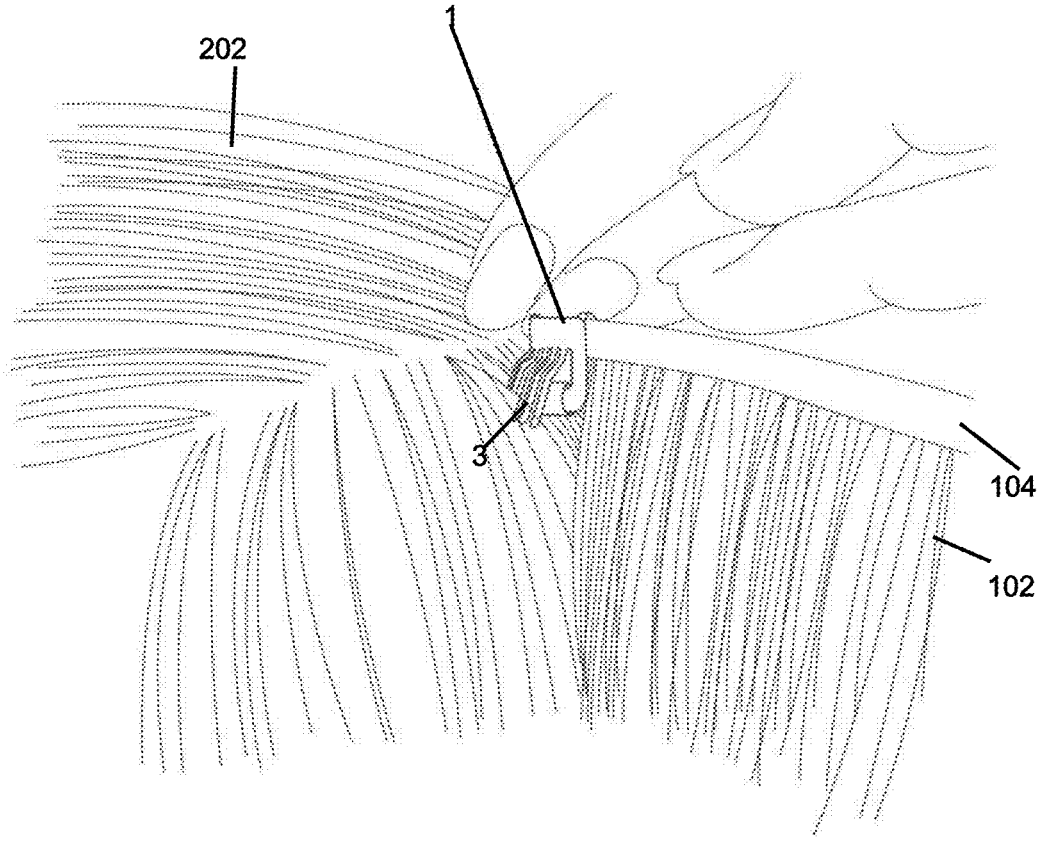
FIG. 9 shows a close up view of the hair extension being attached to hair in an embodiment of the disclosed technology.

FIG. 9 shows a close up view of the hair extension being attached to hair in an embodiment of the disclosed technology. The prongs 3 are extended away from the body of clip 1, and the hair 202 of a person is placed between the prongs 3 themselves and/or between the body of clip 1 and prongs 3. The weft 104 is already held by the weft clips of the hair clip, and so the entire hair extension is now attached to the real hair of the wearer.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

I claim:

1. A hair clip, comprising:

a rectangular base frame having longer upper and lower sides than left and right sides;

a cushion frame fixedly attached to, and extending across, said lower side of said rectangular base frame;

an elastic cushion wrapped around a majority of said cushion frame;

a plurality of prongs forming a unitary structure with said base frame extending from said upper side of said base frame, said prongs held with tension against said elastic cushion;

a weft clip frame fixedly attached to, and extending across, said upper side of said rectangular base frame;

two spaced apart weft clips forming a unitary structure with said weft clip frame, said weft clips forming a U-shape, with a portion of said U-shape on either side of said rectangular base frame and extending over an uppermost extremity of said longer upper side.

2. The hair clip of claim 1, wherein each said weft clip further folds back into itself, within said U-shape.

3. The clip of claim 2, wherein each said spaced-apart weft clip further comprises a hollow pocket formed within said fold, said hollow pocket opening only facing towards said portion of said U-shape extending over said uppermost extremity of said longer upper side.

4. The clip of claim 3, further being part of a kit with a hair extension, said hair extension comprising a weft and hair;

wherein said weft is frictionally held between said rectangular base frame and said two spaced apart weft clips.

5. The clip of claim 4, wherein said weft is held in each said hollow pocket of each said weft clip such that pulling said hair extension in a direction away from said upper side towards said lower side of said rectangular base is ineffective in removing said hair extension without destroying said hair extension.

6. A hair clip comprising:

a top portion of a rectangular base frame having weft clips that curve into themselves, forming a frictional attachment mechanism between said top portion of said base and each of said weft clips, wherein each said weft clip has a continuous hollow pocket for which a majority thereof is bisected by each said curve turning into itself;

a plurality of prongs extending from said top portion of said base past a bottom portion of said base, said bottom portion on an opposite side of a hollow area of said base between said top and bottom portions, wherein said plurality of prongs form a frictional attachment mechanism between said plurality of prongs and said bottom portion of said base;

a cushion frame fixedly attached to, and extending across, said rectangular base frame with an elastic cushion wrapped around a majority of said cushion frame.

7. The hair clip of claim 6, further comprising a weft clip frame fixedly attached to, and extending across, said top portion of said rectangular base frame, wherein said weft clip frame is a unitary structure with each said weft clip.

8. The hair clip of claim 6, wherein each said weft clip forms a U-shape with a portion of said U-shape on either side of said base.

9. The hair clip of claim 6, wherein said weft clips hold a weft slid between each of said weft clips and said base.

10. The hair clip of claim 9, wherein said weft is held within each said continuous hollow pocket of each said weft clip after passing around and into said curve turning into itself.

11. The hair clip of claim 10, wherein a bulbous portion of said hollow pocket is defined by said curve turning into itself and two sides of said U-shape portion of said weft clip.

12. A hair clip method of using the hair clip of claim 6, comprising the steps of:

sliding a weft of a hair extension in a direction from a said bottom portion of said rectangular base frame of a hair clip to said top portion of said rectangular base frame of said hair clip, said top portion further comprising at least two spaced-apart weft clips where said bottom portion is opposite said top portion;

pushing said weft between said at least two spaced-apart weft clips and said base;

pushing human hair between a plurality of prongs and said base, said plurality of prongs extending from a side opposite said at least two spaced apart weft clips.

13. The hair clip method of use of claim 12, further comprising a step of rotating said weft into said hollow portion of each of said two spaced-apart weft clips simultaneously, said hollow portion being surrounded by said weft clip by at least 270 degrees.

14. The hair clip method of use of claim 12, wherein said hollow portion is bulbous.

* * * * *